US005267688A

United States Patent [19]

Benefield

[11] Patent Number: 5,267,688

[45] Date of Patent: Dec. 7, 1993

[54] LOCKING DEVICE FOR MAILBOXES

[76] Inventor: James Benefield, 133 E. 140th St., Los Angeles, Calif. 90061

[21] Appl. No.: 990,181

[22] Filed: Dec. 14, 1992

[51] Int. Cl.[5] ..... E05B 13/00

[52] U.S. Cl. ..... 232/17; 70/94; 70/164; 70/423; 232/25; 292/340; 312/216

[58] Field of Search ..... 70/14, 57, 58, 62, 63, 70/94, 114, 158, 159, 164, 166, 167, 230, 416, 417, 423, 424, 427, 428, 455; 312/216, 107.5; 232/17, 24, 25, 45; 292/32, 340, 341

[56] References Cited

U.S. PATENT DOCUMENTS

| | | | |
|---|---|---|---|
| 2,794,663 | 6/1957 | Grodt et al. | 292/340 X |
| 2,803,512 | 8/1957 | Band | 312/298 |
| 2,853,231 | 9/1958 | Yorgey et al. | 232/43.4 |
| 3,665,736 | 5/1972 | Wilson | 70/427 X |
| 4,269,048 | 5/1981 | McDorman | 70/165 X |
| 4,455,846 | 6/1984 | Wichinsky | 70/94 |
| 4,669,767 | 6/1987 | Leto | 70/94 X |
| 4,796,445 | 1/1989 | Norden, Jr. | 70/94 |
| 5,103,659 | 4/1992 | Benefield | 70/164 X |

FOREIGN PATENT DOCUMENTS 2595934 9/1987 France .

*Primary Examiner*—Peter M. Cuomo
*Assistant Examiner*—Suzanne L. Dino
*Attorney, Agent, or Firm*—Julius Rubinstein

[57] ABSTRACT

A gang mail box for an apartment building comprising an outer frame and an inner frame. The inner frame is pivotally connected to the outer frame which is secured to a wall of the building. A number of individual mail boxes corresponding to the number of apartments are mounted on and pivotal with the inner frame. These individual mail boxes are shaped so when the inner frame is pivoted, the tops of the individual mail boxes are exposed so the mail carrier can insert mail in them. Each mail box is provided with a hinged door having an individual mail box lock. A tempered steel security bar is provided to cover and conceal the tenants' locks on the individual mail boxes to prevent theft. This bar is hinged to the inner frame and is provided with a padlock for securing the bar in place.

10 Claims, 3 Drawing Sheets

LOCKING DEVICE FOR MAILBOXES

This invention relates to a gang mail box for apartment buildings, and more particularly to a burglar-proof device for shielding and protecting the tenant's mail boxes.

FEDERALLY SPONSORED RESEARCH

No part of this invention involved any federally sponsored research.

RELATED ART

This patent application is an improvement over patent application 07/472,652, now U.S. Pat. No. 5,103,659 which is also a continuation in part of patent application Ser. No. 289,715, which is a continuation in part of patent application Ser. No. 191,045 by the same inventor. The problem with the prior patent applications was that post office regulations require gang mail boxes that can be opened by a single key carried by the mail man. However the structure of the prior gang mail boxes described in the patent applications identified above, was such that they required the postman to carry multiple keys or specially constructed keys to gain access to the gang mail box.

BACKGROUND AND BRIEF SUMMARY

In recent years the theft of mail from mail boxes in apartment buildings has increased enormously. One of the reasons for these felonious acts is that the number of tenants who receive monthly social security, dividend, and interest checks has risen dramatically. Since the locks on the doors of the individual mail boxes are rather flimsy, it is not difficult to pry them open. As a consequence, the incidence of mail box robberies, when social security checks or income tax refund checks are due, has increased substantially.

What is needed, therefore, and comprises an important object of this invention is to provide a means for simultaneously locking and shielding all the locks of the tenants' mail boxes in a gang mail box to prevent these thefts.

To do this, a security bar formed from a hardened and tempered steel is removably mounted on a pivotally mounted support frame carrying the individual tenants mail boxes. The security bar is mounted in such a way that it covers and conceals the locks on each tenant mail box and is movable with the support frame when the support frame is pivoted. In this way the postman carrying a single key can pivot the support frame carrying the tenants' mail boxes to a position where the mail can be distributed in each box without disturbing the security bar while the keys for the locks on each tenant mail box are carried by the tenants.

What is needed therefore and comprises another important object of this invention is to provide a gang mail box with the features described above.

These and other objects of this invention will become more apparent when better understood in the light of the accompanying specification and drawings wherein:

DETAILED DESCRIPTION OF THE INVENTION

Figure 1:
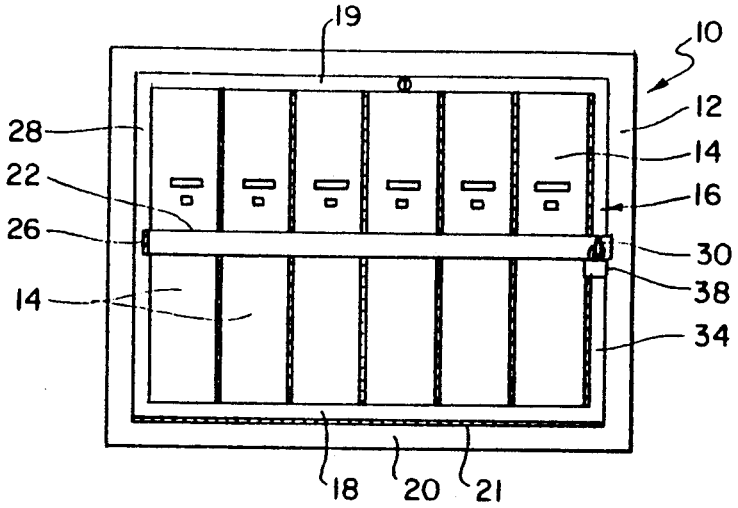
FIG. 1 is an elevational view of one embodiment of a gang mail box for apartment buildings showing a security bar shielding and protecting the tenants' mail boxes.
Figure 2:
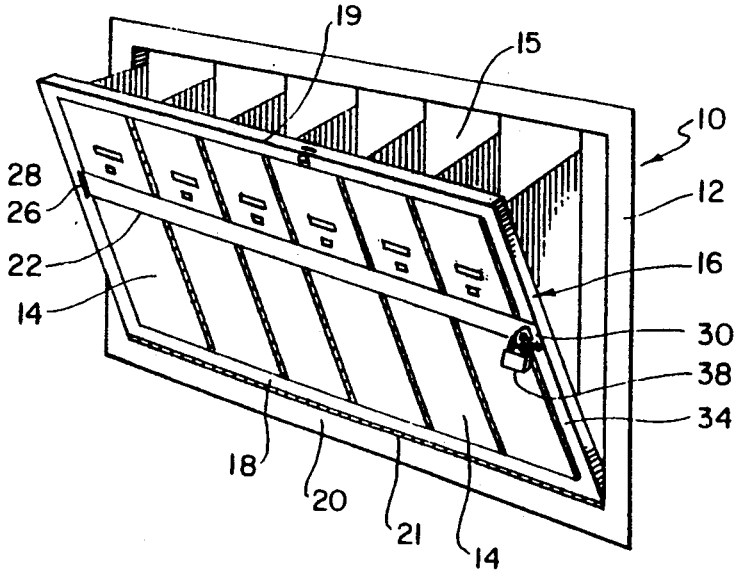
FIG. 2 is a perspective view of the individual tenant's mail boxes shown in FIG. 1 wherein the inner frame holding the individual mail boxes is pivoted forward permitting the postman to distribute the mail and showing the security bar remaining in place covering the mail box locks.

Referring now to FIG. 1 of the drawing, an apartment gang mail box 10 for an apartment building is mounted on a first outer support frame 12 which is secured to the wall of an apartment building by any suitable means. A second inner support frame 16 has side member 28 and 34 and connecting top and bottom bars 18 and 19. A plurality of individual tenant mail boxes 14 are mounted on the second support frame and connected to the top and bottom bars 18 and 19. The bottom bar 18 of the second inner frame is pivotally secured to the fixed bottom bar 20 of the outer frame by means of a hinge 21. With this arrangement, as shown in FIG. 2 the second inner frame 16 along with all the tenants' mail boxes 14 can pivot forward along with the security bar 22, thereby revealing the open tops 15 of the mail boxes permitting the mailman to distribute mail in these boxes, see FIG. 2.

Figure 3:
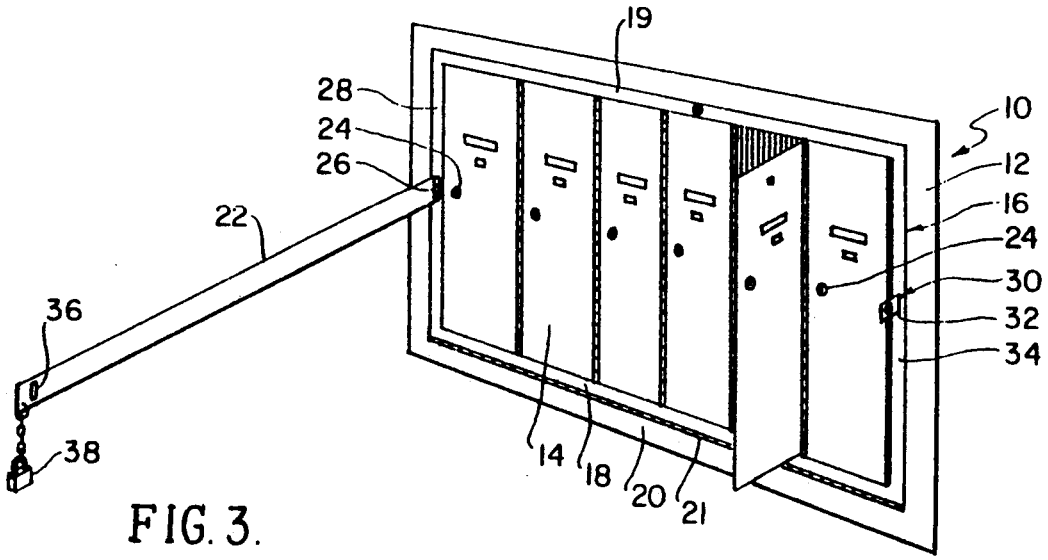
FIG. 3 is a view similar to FIG. 1 showing the security bar in an open position exposing the individual mail box locks.

The security bar 22, has a padlock 38 which holds the security bar in a position which shields and protects the individual mail box locks 24, FIG. 3. The individual mail box locks 24 when left exposed as shown in FIG. 3 are easy to pry open thus permitting the mail box contents to be stolen. However, when the tenants wish to get their mail, the tenants use their security bar key to remove the padlock 38 and pivot the security bar to the position shown in FIG. 3. This exposes the mail box locks 24 enabling the tenants to use their private mail box keys to open their individual mail boxes. It is noted that since the security bar moves with the inner frame, it does not need to be disturbed by the mail man.

The security bar 22, is wide enough so that when it is in a locked position as shown in FIG. 1 it abuts the outer surface of the individual tenants' mail boxes and covers the tenants' mail box locks 24 thus preventing thieves from gaining access to them.

As shown in FIG. 1, one end of the security bar 22 is pivotally connected to a hinge 26 secured to the inner frame side bar 28.

A hasp 30 comprising a slotted staple 32 is secured to the side bar 34 of the inner frame 16 as shown in FIGS. 1, 2 and 3. A hasp slot 36 is formed in the end of the security bar 22, see FIG. 3. The security bar 22 can be pivoted so the staple 32 mates with the hasp slot 36 formed in the end of the security bar 22, thus enabling the shackle 40 of the padlock 38 to be inserted in the hasp 30. Thus the security bar 22, as shown in FIG. 1, securely shields the individual mail box locks 24.

The tenant is supplied with a key for unlocking the padlock 38 so he can pivot the security bar 22 away from the mail boxes 14 and expose the individual mail box locks 24 when he desires to get his mail, see FIG. 3.

Figure 4:
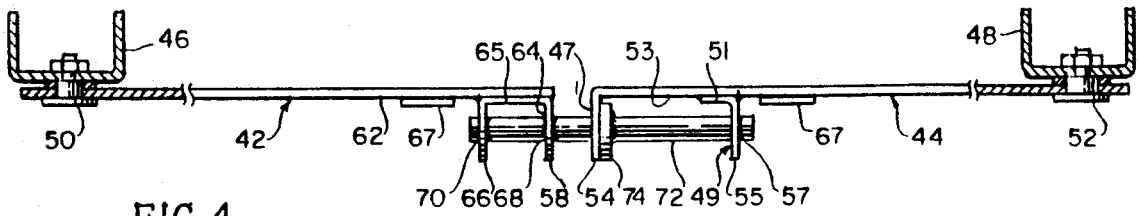
FIG. 4 is a plan view of an alternate locking means comprising a security bar formed in two parts with each part pivotally mounted on the inner frame.

Larger apartment buildings having many tenants and a larger number of mail boxes require a much longer security bar 22. This would make the bar 22 awkward to handle. An alternate design to alleviate this problem is shown in FIG. 4 whereby the security bar is formed in two parts 42 and 44. Parts 42 and 44 have facing ends 60 and 61 respectively which are close to each other when the security bar 22 is in a gang mail box locking position, and opposite ends 46 and 48 which are remote from ends 60 and 61 and are adjacent side bars 28 and 34. The opposite ends 46 and 48 are pivotally connected to pivot studs 50 and 52 which are secured by any suitable means to the side bars 28 and 34 of the inner frame 16, see FIGS. 3 and 4.

Figure 5:
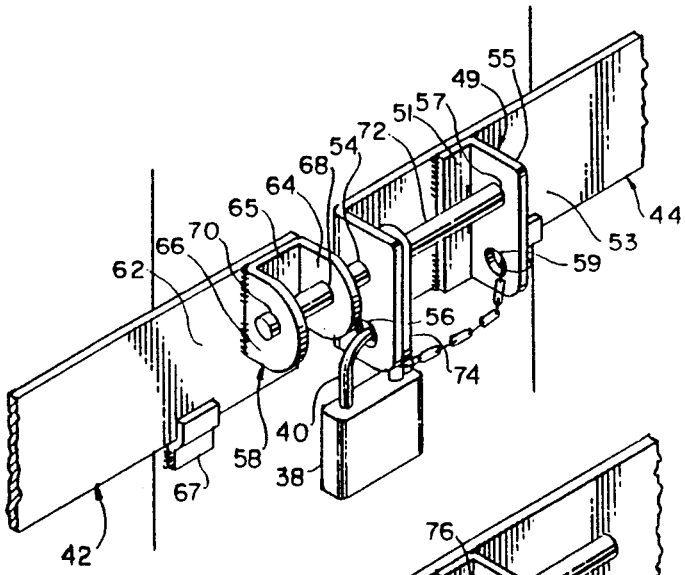
FIG. 5 is a perspective view showing the two bar parts held together in a horizontal position in a position to shield and cover the locks of the tenants' individual mail boxes.

The bar parts 42 and 44 are held in straight alignment by means of a slide bolt locking device, see FIG. 5. As shown in FIG. 3, the inner or facing end 61 of bar 44 is bent to form a transverse flange 47. Flange 47 has a first rod receiving hole 54 and a second hole 56 for receiving the shackle 40 of the padlock 38. In addition a generally L shaped flange 49 comprises a flat mounting portion 51 welded to the facing surface 53 of the bar 44 and a transverse flange portion 55 extending outwardly transverse to surface 53, see FIG. 5. The flange portion 55 has a slide bar receiving hole 57 and a chain or shackle receiving hole 59 extending therethrough to attach the padlock 38 to the flange 49.

The facing end 60 of side bar 42 has a generally channel shaped member 58. The channel shaped member 58 includes side arms 64 and 66 and a connecting web portion 65, see FIG. 5. The web portion 65 is welded to surface 62 of side bar 42. The arms 64 and 66 of the channel shaped member 58 are provided with aligned slide rod receiving holes 68 and 70 extending therethrough, see FIG. 6.

When the bar parts 42 and 44 are in alignment all the bar receiving holes 57, 54, 68 and 70 are aligned and a straight slide rod 72 extends through these holes for maintaining the arms 42 and 44 in horizontal alignment so they cover all the locks 24 of the individual tenant mail boxes 14. Support clips 67 welded to the face of the mailbox support the bar parts 42 and 44 in alignment as the slide rod 72 is rammed in place.

A flange like abutment 74 is provided with a first rod receiving opening 76 through which the slide rod 72 extends. The abutment 74 is welded to the slide rod 72 at the opening 76 so that the abutment 74 is permanently attached to the slide rod 72. The abutment 74 is provided with a second hole 78 for attachment of the shackle 40 of padlock 38 to prevent the slide bar 72 being moved after engaging the other half of the security bar 42.

With the arrangement described so far, when the bar parts 42 and 44 are locked together in alignment, covering the locks 24 of the individual mail boxes 14, the slide rod 72 extends through the aligned openings 57, 54, 70, and 68. The shackle 40 of the padlock 38 including the chain 79 extends through the opening 56 in flange 47, the opening 78 in flange 74 and opening 59 in flange 55 for attachment to the lock 38 so that the padlock 38 cannot be removed from the first part 44 of the security bar.

When a tenant wishes to get his mail, in the mail box 10 shown in FIG. 1 he unlocks padlock 38 and removes the shackle 40 from the slotted staple 32 in hasp 30 and the hasp slot 36 in the end of the security bar 22. Then he pivots the security bar 22 as shown in FIG. 3 to expose the individual locks 24 in the private mail boxes 14.

Figure 6:
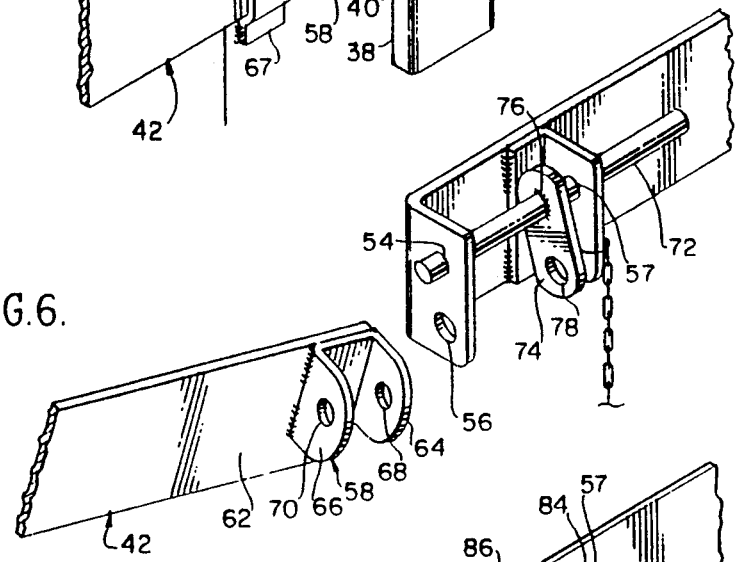
FIG. 6 is a perspective view of two bar parts shown in FIG. 1 disclosing a portion of one of the bar parts pivoted downwardly to expose the locks of the individual tenants' mail boxes so the tenant's can get their mail.

When a tenant wishes to retrieve his mail from a larger gang mail box where the security bar is formed in two sections, 42 and 44, as shown in FIGS. 4, 5, and 6, he first removes the padlock 38. Then he retracts the slide bar 72 from the openings 70 and 68 in arms 64 and 66 of the channel shaped member enabling the bar members 42 and 44 to swing downward on pivots 50 and 52 as shown in FIGS. 4 and 6 thus exposing the individual mail box locks 24, permitting each tenant to open his mail box 14.

Figure 7:
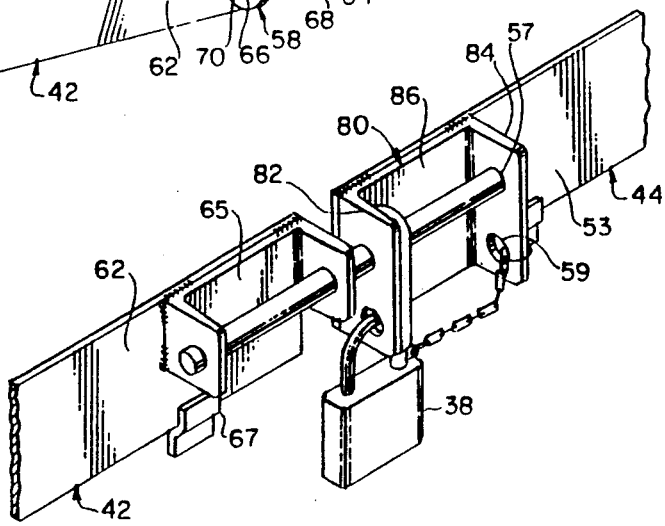
FIG. 7 is a perspective view of an alternate embodiment of the portions of the bar parts shown in FIG. 5.

A review of the embodiment of the locking means shown in FIG. 4 shows that the end of the bar part 44 has to be bent to form a flange 47 and the L-shaped flange 49 has to be welded to the facing surface 53 of bar part 44. In the alternate embodiment shown in FIG. 7 the end of the bar part 44 is straight thereby eliminating a bending operation in its manufacture. A channel shaped member 80 having transverse arms 82 and 84 and a connecting web portion 86 is provided. The channel shaped members 80 on parts 42 and 44 are identical in cross section for reasons of economy. The web portion 86 is welded to the facing surface 53 as shown in FIG. 7. Rod and shackle receiving holes 54 and 56 are drilled in arm 82 and rod and chain receiving openings 57 and 59 are drilled in arm 84, as shown.

In all other respects the operation of the embodiment shown in FIG. 7 is the same as the embodiment shown in FIG. 6. The advantages of the embodiment shown in FIG. 7 is that a single stock item channel shaped bar stock can be cut to the proper lengths so their web portions 65 and 86 can be welded or otherwise secured to the facing ends 60 and 61 of bar parts 42 and 44. As a consequence, the manufacturing costs of the embodiment shown in FIG. 7 may be less.

The embodiment 100 shown in FIGS. 8, 9, 10, and 11 differs from the embodiment shown in FIGS. 1, 2, 4, and 7 only in the design of the security bar 102. This bar like the bar shown in FIG. 4 is formed in two parts 104 and 106, which are positioned to cover the tenant's mail box locks. The remote ends 108 and 110 of the bar parts 104 and 106 are provided with horizontally extending slots 112 and 114, see FIGS. 8 and 9. Pivot studs 116 and 118 extend through and ride in these slots and on into the side bars 28 and 34 of the inner frame, see FIGS. 8 and 9. In this way, the bar parts 104 and 106 can be moved away from each other with the pivot studs 116 and 118 engaged in the slots 112 and 114, and can pivot to a vertical position. The first and second parts of the security bar when dropped to their vertical position clear the doors of the two outer mail boxes.

Figure 9:
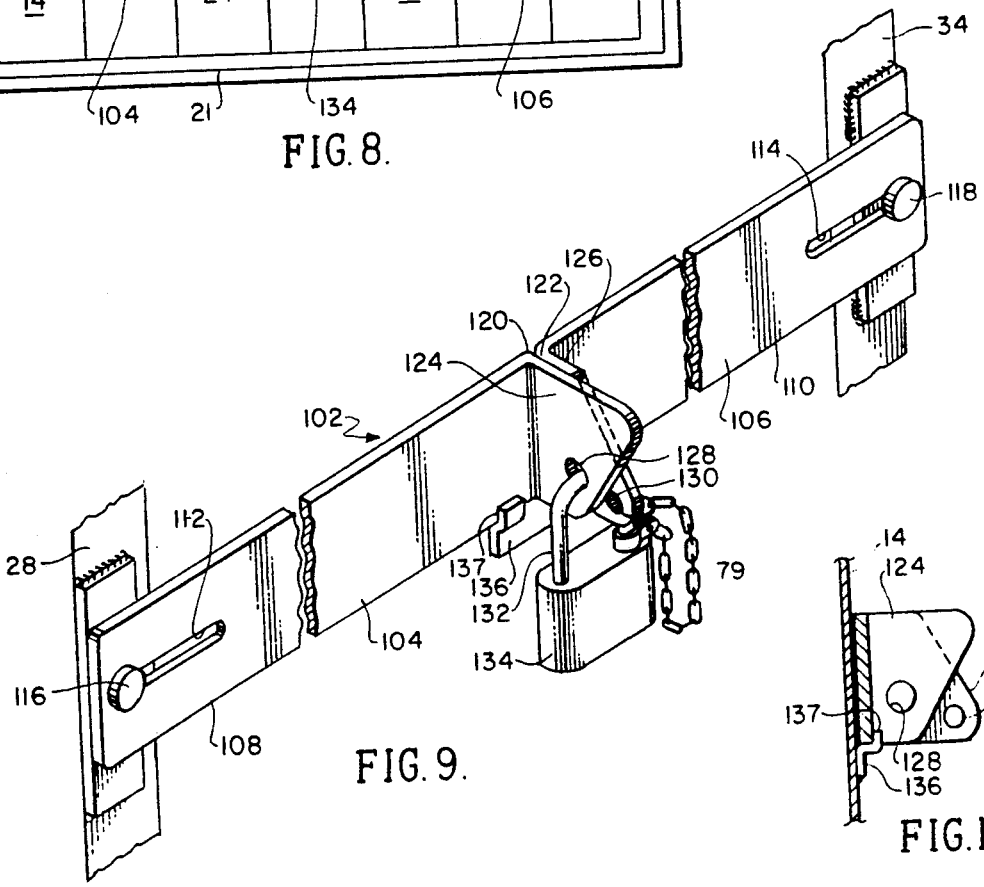
FIG. 9 is a perspective view of a preferred embodiment of the apartment gang mail box disclosing a security bar formed in two parts and with the remote ends of the parts provided with horizontal slots and the abutting facing ends of the bar shaped in the form of a generally triangular flange.
Figure 11:
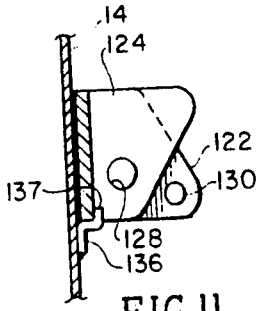
FIG. 11 is a sectional view taken on the line 11—11 of FIG. 10.
Figure 10:
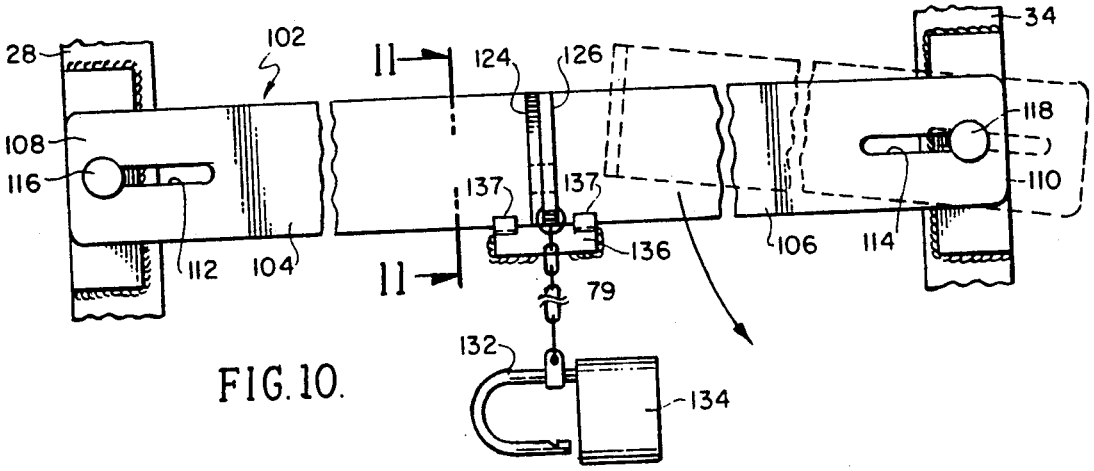
FIG. 10 is an elevational view of the security bar shown in FIG. 9 showing one part of the bar moved away from the other part and pivoted toward a vertical position.

The facing 120 and 122 ends of said first and second parts 104 and 106 of the security bar are shaped to form generally triangular flanges 124 and 126, see FIGS. 9 and 11 to facilitate their disengagement by providing a finger grip to the ends. When the first and second parts 104 and 106 of the security bar 102 are placed in position to conceal the tenants' mail box locks, the flanges 124 and 126 abut to enable the insertion of the shackle 132 of the padlock 134 see FIGS. 9 and 11. Shackle receiving openings 128 and 130 are provided in the two flanges 124 and 126 for receiving the shackle 132 of a padlock 134, see FIG. 9.

Figure 8:
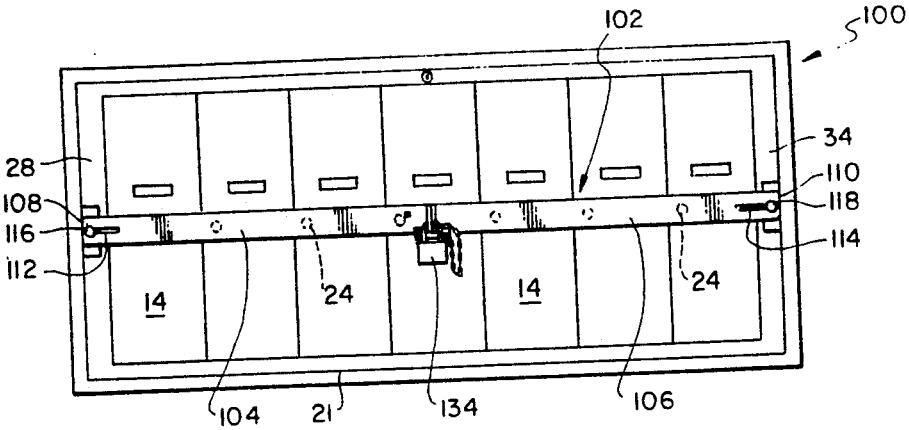
FIG. 8 is a plan view of an apartment gang mail box showing another embodiment of the security bar shielding the tenants' mail box locks.

To place parts 104 and 106 of the security bar 102 in horizontal alignment a support clip 136 is rigidly welded to the face of the center mail box, see FIGS. 8, 9 and 11. Projecting ends 137 of the clip 136 maintain the security bar parts 104 and 106 tightly abutted against the mail box locks 24.

Having described the invention, what I claim as new is:

1. An apartment gang mail box comprising a first outer frame adapted to be mounted on the wall of a building, a second inner frame pivotally connected to said outer frame, a plurality of individual tenant mail boxes mounted in said second inner frame, each individual tenant mail box having an open top concealed by the outer frame and a door, a tenant's mail box lock mounted in each door, said inner frame pivotally connected to said first outer frame so that the entire inner frame along with the individual tenant mail boxes can be pivoted in a direction that exposes the open tops of the tenant's mail boxes to permit the mailman to insert mail into each of the individual mail boxes, and removable means movable with said inner frame covering and concealing the individual tenant mail box locks for preventing theft of mail from the tenant's mail boxes.

2. The apartment mail box described in claim 1 wherein said removable means comprises a security bar mounted on said inner frame, said security bar removably locked and positioned to abut the outer surface of the individual tenant mail boxes and wide enough to cover the individual tenant mail box locks to prevent thieves from breaking into the tenant mail boxes by prying open the tenant mail box locks.

3. The apartment gang mail box described in claim 2 wherein said inner frame has side members, and connecting top and bottom members, said individual mail boxes connected to the top and bottom bars of said inner frame, a hinge secured to one side member of said inner frame and a hasp secured to an opposite side member of said inner frame, said security bar having opposed ends, one end of said security bar connected to said hinge, a hasp slot formed in the opposite end of said security bar, said hasp including a staple having a hole extending therethrough, said staple sized to enter said hasp slot, and a padlock including a shackle, the shackle of said padlock sized to extend through said hasp slot and said staple hole to hold said security bar in abutting relationship to the outer surface of said mail box in a position to cover and shield said tenant mail box locks.

4. The apartment mail box described in claim 1 wherein said inner frame has side members and connecting top and bottom members, said removable means comprising a security bar mounted on said inner frame for covering and concealing the individual tenant's mail box locks, said security bar comprising a first part and a second part, each part of said security bar having first ends close to and facing each other when said security bar is covering said individual tenant's mail box locks, and opposite ends remote from said first ends and close to said side members, pivots mounted on said side members of said inner frame, the said opposite ends of each of said parts of said security bar connected to said pivots whereby each part of said security bar can rotate on said pivots to expose the mail box locks on each tenants mail box, means on the first ends of the first and second parts of said security bar for holding and locking the first and second parts of said security bar in straight alignment with respect to each other and in abutting relationship to the outer surface of the individual tenant mail boxes, said first and second parts of said security bar wide enough to cover the individual tenant mail box locks on the door of each mail box to prevent thieves form breaking into the tenant's mail boxes by prying open the tenant's mail box locks.

5. The apartment mail box described in claim 4 wherein said means on the first and second parts of said security bar include a first transverse flange on the first end of said first part of said security bar, said first transverse flange having a first slide rod receiving hole and a spaced first shackle receiving hole formed therein, a generally L-shaped flange mounted on said first part of said security bar in spaced relationship to said first transverse flange, said L-shaped flange including a mounting portion secured to a surface of said first part of said security bar and a second transverse flange secured to said first part of said security bar and in spaced relationship to said first transverse flange, said second transverse flange having a second slide rod receiving opening formed therein aligned with said first slide rod receiving opening and a spaced second shackle receiving opening, the slide rod receiving openings in said first and second transverse flanges positioned to receive a slide rod extending parallel to said first and second parts of said security bar, the first end of said second part of said security bar having a channel shaped member secured to a surface of said second part of said security bar, the arms of said channel shaped members extending transverse to said second part of said security bar, each of said arms having aligned slide rod receiving openings extending therethrough, said slide rod receiving openings in said arms in said second part of said security bar in alignment with said slide rod receiving openings in said first and second transverse flanges in said first part of said security bar, a slide rod movably extending through said slide rod receiving openings in said first part of said security bar and extending through said slide rod receiving openings in said arms of said channel shaped member in said second part of said security bar, an abutting flange rigidly secured to said rod and movable therewith and positioned between said first and second transverse flanges in said first part of said security bar, said abutting flange having a third shackle receiving opening formed therein so when said slide rod is moved until said abutting flange engages said first transverse flange while said slide rod extends through said aligned slide rod receiving openings in said first and second transverse flanges and said slide rod receiving openings in said arms of said channel shaped flanges, a shackle can extend through said first, second, and third shackle receiving openings for attachment to a lock to which the shackle may be connected whereby as long as the lock is closed, said first and second parts of said security bar are held together in straight alignment and covering the individual tenants mail box locks.

6. The apartment mail box described in claim 4 wherein each of the first ends of the first and second parts of said security bar are straight, said first and second parts of said security bar having surfaces, first and second channel shaped members secured to said surfaces and positioned so their arms are transverse to said security bar and with one arm of each channel shaped member adjacent the first end of the first and second parts of said security bar when said security bar is positioned to cover the mail box locks in each tenant mail box, slide rod receiving openings extending through all of said transverse arms in alignment with each other, a slide rod movably extending through said aligned slide rod receiving openings, an abutting flange secured to said slide rod positioned between the arms of said first channel shaped member and movable therewith, the transverse arm adjacent the first end of said first part of said security bar having a first shackle receiving hole formed therein, said abutting flange having a second shackle receiving hole formed therein, the transverse arm of said first channel shaped member spaced from the first end of said first part of said security bar having a third shackle receiving hole formed therein, so that a shackle can extend through said first, second, and third shackle receiving openings in the transverse arms of the first channel shaped member whereby when said shackle is secured to a lock while said slide rod extends through the aligned slide rod receiving openings in the arms of said channel shaped members, the first and second parts of said security bars are locked together in straight alignment covering the individual tenants mail box locks until the shackle is released from the lock.

7. The apartment mail box described in claim 6 wherein said channel shaped members secured to the said surfaces of the first and second parts of said locking bar are identical in shape.

8. An apartment gang mail box comprising an outer frame adapted to be mounted on the wall of a building, an inner frame, a plurality of individual tenant mail boxes mounted in said inner frame, each individual tenant mail box having an open top concealed by the outer frame and a door, a tenant's mail box lock mounted in each door, said inner frame pivotally connected to said outer frame so that the entire inner frame along with the individual tenant mail boxes can be pivoted in a direction that exposes the open tops of the tenant's mail boxes to permit the mailman to insert mail into each of the individual mail boxes, said inner frame having side members and connecting top and bottom members, a security bar mounted on said inner frame, said security bar comprising a first part and a second part, each part of said security bar having first ends close to and facing each other when said first and second parts are in alignment with each other and covering said individual tenant's mail box locks and opposite ends remote from said first ends and adjacent said side bars, elongated slots extending parallel to said first and second parts of said security bar formed in the said opposite remote ends of said first and second parts of said bar, pivot rods extending through said elongated slots and into said side members of said inner frame whereby the first and second parts of said bar can be moved away from each other with said pivot rods riding in said slots and so said first and second parts of said security bar can pivot on said pivot rods to a position out of the way of said doors of the individual tenant's mail boxes whereby the doors of the tenant's mail boxes can open, the first ends of said first and second parts of said security bar shaped so they form a flange, said security bar sized and positioned so when the first and second parts of the bar cover the tenants mail box locks, the said flanges are at least close to each other, shackle receiving openings extending through said flanges for receiving the shackle of a padlock, whereby when the flanges are in alignment and the shackle of a padlock extends through said openings, the first and second parts of said bar are held in linear alignment and are positioned so they cover and conceal the tenants mail box locks to prevent thieves from breaking into the tenant's mail boxes by breaking through the tenant's mail box locks.

9. The apartment gang mail box described in claim 8 including at least one support member mounted on the face of a mail box and positioned beneath and abutting the bar to support the bar in horizontal alignment.

10. The apartment gang mail box described in claim 8 wherein said flanges are generally triangular in shape.

* * * * *